United States Patent [19]

Eckart

[11] 4,294,461

[45] Oct. 13, 1981

[54] SAFETY SKI BINDING COMPRISING A SOLE PLATE

[76] Inventor: Erich G. Eckart, Angererstr. 36, 8000 München 40, Fed. Rep. of Germany

[21] Appl. No.: 95,441

[22] Filed: Nov. 19, 1979

[30] Foreign Application Priority Data

Nov. 29, 1978 [DE] Fed. Rep. of Germany ..... 2851634

[51] Int. Cl.[3] ..... A63C 9/081

[52] U.S. Cl. ..... 280/618; 280/628

[58] Field of Search ..... 280/618, 620, 628, 631, 280/632, 634, 611

[56] References Cited

U.S. PATENT DOCUMENTS

| | | | |
|---|---|---|---|
| 3,689,095 | 9/1972 | Salomon | 280/628 |
| 3,884,489 | 5/1975 | Gertsch et al. | 280/618 |
| 3,937,480 | 2/1976 | Korger | 280/618 |
| 4,165,883 | 8/1979 | Weigl et al. | 280/618 |

FOREIGN PATENT DOCUMENTS

| | | | |
|---|---|---|---|
| 2504281 | 8/1976 | Fed. Rep. of Germany | 280/620 |

*Primary Examiner*—David M. Mitchell

*Attorney, Agent, or Firm*—Bacon & Thomas

[57] ABSTRACT

Safety ski binding comprising a sole plate which is releasably connected to the ski by a trunnion located approximately beneath the heel and further comprising a sole mount and heel assembly affixed to said sole plate, whereby a double-armed rocker is mounted in said heel assembly so as to pivot about a horizontal axis extending perpendicular to the ski, the one arm of said rocker projecting rearwardly and being designed as sliding cam and being in engagement with a curved member affixed to the ski and the second arm of said rocker being articulated with a tension carriage for a spring, whereby the pre-biased spring urging the rearward arm of the rocker onto said curved member.

8 Claims, 3 Drawing Figures

SAFETY SKI BINDING COMPRISING A SOLE PLATE

BACKGROUND OF THE INVENTION

This invention relates to a safety ski binding comprising a sole plate which is releasably connected to the ski by a trunnion located approximately beneath the heel and further comprising a sole mount affixed to said sole plate and a heel assembly which is adapted to pivot about an axis perpendicular to the ski under spring tension and which co-operates via a cam with a curved member which is rigidly attached to the ski, which centers said heel assembly in a middle position and along which the cam glides when said sole plate is twisted, thereby tensioning the spring and pivoting said heel assembly to release the boot.

DESCRIPTION OF THE PRIOR ART

What are termed plate bindings have recently appeared in the field of safety ski bindings. These are bindings in which the boot is secured on a plate and the plate, together with the boot, is released when a limit load is exceeded. Compared to conventional "step in" safety bindings, this plate binding system demonstrates the essential advantage of greater safety, since the release values are hardly influenced by environmental factors such as iceing and dirt. The drawback of common plate bindings, where the plate remains attached to the boot after release, is the relatively complicated mechanism for locking the plate to the ski and, in particular, the reintroduction of the plate into this mechanism after a fall.

A plate binding is already known in which the plate does not disengage from the ski, but is secured to the ski by means of a trunnion located beneath the axis of rotation of the leg. In this known binding, the heel assembly is mounted on the sole plate so as to be pivoted. In case of a fall towards the front and corresponding forces exerted on the heel assembly, this pivots, thereby tensioning a spring, and releases the boot after a specific limit value is exceeded.

The heel assembly includes a downwardly directed cam in the form of a vertical pin which co-operates with a curved member affixed to the ski. In a top elevation, this curved member has an approximately V-shaped contour and is provided with two surfaces which converge at an acute angle proceeding from the heel and extending towards the rear. When the binding is in its downhill running position, the pin is located approximately at the apex of this angle formed by the two surfaces. In case of a rotational or torsional fall and a corresponding torque exerted on the sole plate, this pivots relative to the ski, and the pin slides along the respective surface of the curved member. This exerts a canting force on the heel assembly which causes the spring disposed in the heel assembly to be tensioned and, finally, after exceeding the limit value, causes the heel assembly to be pivoted completely, thus releasing the boot.

Compared to all other bindings, this one is advantageous in that only one sole tensioning element is required both for frontal as well as rotational falls, thus resulting in a very considerable simplification of construction, without in any way departing from the safety aspect. The disadvantage, however, is that the spring in the heel assembly is not tensioned directly in case of a rotational fall, as is the case with a frontal fall, but is tensioned by the mediation of the V-shaped curved member including the surfaces thereof. Hence, as the binding pivots laterally, the heel assembly pivots simultaneously, thereby loosening the positive engagement with the boot. This is also a drawback (German laying-open print DE-OS2,504,281).

SUMMARY OF THE INVENTION

The object of the invention is to provide a safety binding of the type designated at the outset in which the sole spring in the heel assembly is influenced directly and without the mediation of other coupling members in case of both frontal and rotational loads.

This object is accomplished in accordance with the invention by a double-armed rocker mounted in said heel assembly so as to pivot about a horizontal axis extending perpendicular to the ski, one arm of said rocker projecting rearwardly from said heel assembly being designed as a sliding cam and being supported on a curved member and a second arm of said rocker being articulated with a tension carriage for the spring and a pre-biased spring urging the rocker onto said curved member, thereby maintaining the heel assembly in the downhill running position.

The rocker which co-operates with the curved member is thus the only actuating member which tensions the spring in the event of both a front and a rotational fall. The release characteristics depend on which area of the curved member is traversed by the sliding cam situated at the end of the rocker. The elimination of separate coupling members results in yet a further simplification of the binding.

According to an advantageous further development of the invention, the heel assembly consists of a housing member pivotally mounted between the upwardly projecting, bifurcated ends of said sole plate, an adjusting spindle is mounted in said housing onto which a helical compression spring is slid which presses a carriage with brackets disposed along the spring against a housing stop, that hooks are formed at the free end of said brackets to engage catches formed at the free end of the rocker arm located in the housing and that the axle of said rocker by which the spring force is transmitted to said heel assembly is located beneath the pivotal axis of said heel assembly. The consequence is a compact construction and reliable functioning.

The association of the release characteristics is achieved in that the curved member has a track located in the middle in the longitudinal direction of the ski and another track in the pivotal direction, that said tracks are shaped such that the sliding cam, upon leaving the neutral position corresponding to the downhill running position, is pivoted either in the longitudinal position of the ski or about the trunnion, in so doing surmounting a prominence, thereby tipping the rocker to further tension the spring and, after surmounting said prominence, releases the sliding cam allowing the heel assembly to pivot outwardly. This curved member design also facilitates the release of the binding in the event of combined frontal/torsional loads which are well known to be the cause of most skiing accidents.

The prominences of the track are advantageously less high upon pivoting than the prominence in the longitudinal direction of the ski which must be surmounted by the sliding cam. Different limit values can thus be set for frontal or rotational (torsional) fall. It is customary for the limit value for frontal fall to be higher than that for torsional fall, the values for a combined fall lying therebetween.

Other advantageous further features of the invention are the subject matters of the subclaims.

The inventive binding permits differentiated adjustment and setting of the limit values which are reproducible even under unfavorable environmental factors. Added safety is not purchased at the cost of a complicated construction which is susceptible to trouble or failure, for instance, but rather quite the opposite, since in the event of both frontal and rotational falls, only a single member in the form of a rocker takes effect, tensioning the spring in the heel assembly and releasing the assembly as soon as a specific limit value is exceeded. Especially owing to the property that release is effected when an exactly predetermined force is exceeded even in the event of combined frontal/torsional falls, there is promise that the use of this binding will successfully aid in reducing the frequency of accidents which is still considerable.

BRIEF DESCRIPTION OF THE DRAWING

An embodiment will now be described in the following by way of example with reference to the enclosed drawing, in which:-

DESCRIPTION OF THE PREFERRED EMBODIMENT

Figure 1:
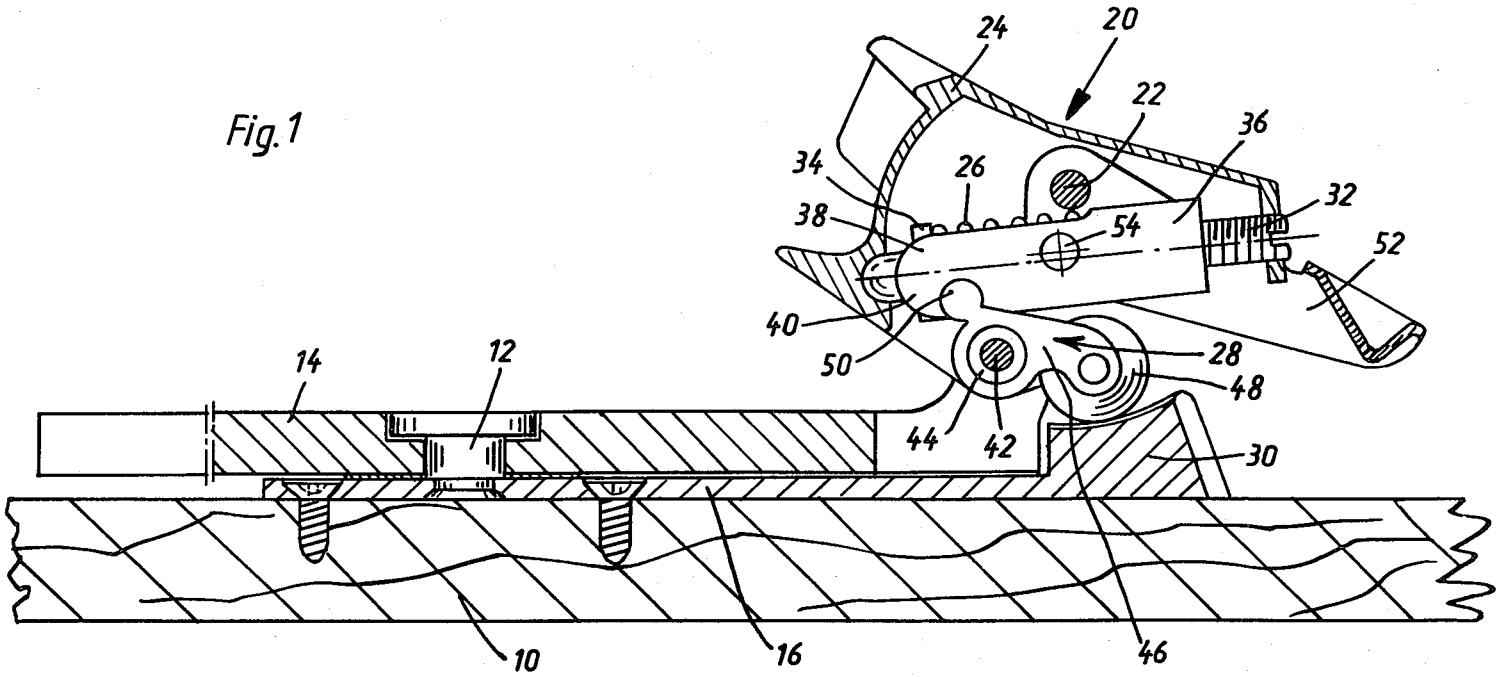
FIG. 1 is a schematic longitudinal section through the binding in its release position.
Figure 2:
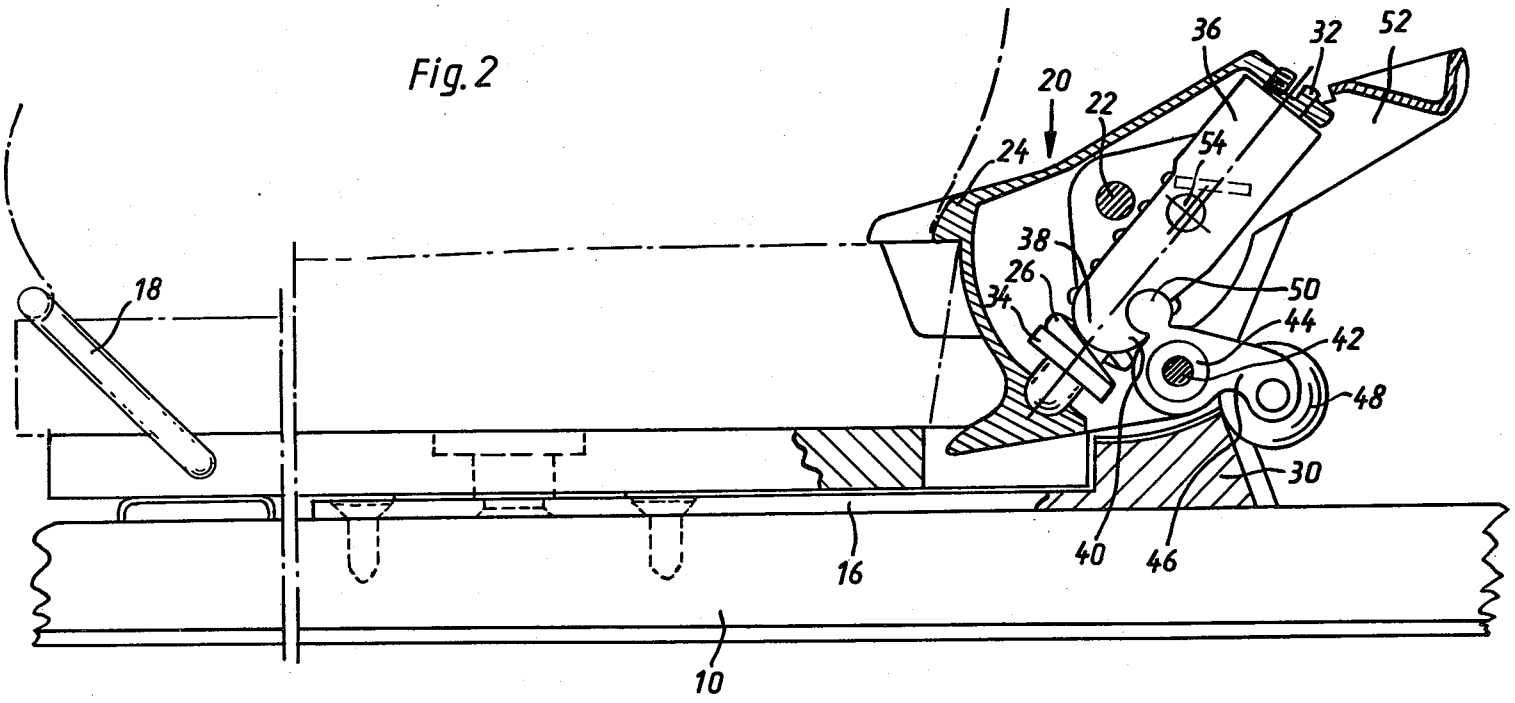
FIG. 2 is a section corresponding to FIG. 1 when the binding is in the downhill running position.

The sole plate 14 is secured to the ski 10 by means of a ball-bearing trunnion 12 in such a way that it is freely pivotal in a horizontal plane relative to the ski. The trunnion 12 can be screwed to the ski by means of a mounting plate 16 as shown in FIG. 1. A sole depressor 18 for the tip of the ski boot is positioned at the front end of the sole plate 14. It can be a simple wire bracket pivotally provided in the sole plate as shown in the embodiment (FIG. 2).

The heel assembly 20 is pivotally mounted at the rear end of the sole plate 14 between two bifurcated projections (not identified) which extend upwardly away from the sole plate. The heel assembly pivots about the horizontal, rigid axle 22 which is directed perpendicular to the longitudinal axis of the ski.

The heel assembly consists of a housing 24 which has appropriate cut-out portions on the side facing towards the heel to press the sole against the sole plate when the binding is in the downhill running position and to permit the simultaneous movement of the heel assembly from its open position (FIG. 1) into the downhill running position (FIG. 2) when the ski boot is depressed into the binding.

The heel assembly 20 is moved into its downhill running position by the co-operative action of a spring element located in the interior of the housing 24, a helical compression spring 26 in the embodiment shown, together with a pivotal rocker 28 and a curved member 30.

An adjusting spindle 32 which is fixed in the housing 24 forms the core of the helical compression spring 26. The adjusting spindle 32, which is mounted to pivot in the housing, includes in the lower area thereof an adjusting nut 34 with the aid of which the pre-biasing force of the spiral compression spring 26 can be altered in a known manner. The left end of spindle 32 bears against the housing, which is a housing stop.

A carriage 36 is slid onto the spring 26. It has a U-shaped profile with side brackets 38 which project downwardly on both sides of the spring. Hooks 40 are formed at the lower ends of the brackets 38 whose function will be described in detail in the following.

The pivotal rocker 28 is mounted on an axle 42 secured in the heel assembly and is located beneath the adjusting spindle 32 (the axle 22, which is rigidly affixed to a plate, is located above the adjusting spindle 32). The rocker 28 has double arms in principle, one arm projecting out of the housing 24 and co-acting with the curved member 30, the other arm projecting into the housing 24 and articulating with the brackets 38 of the carriage 36.

The rocker consists of two parallel tabs 46 which are riveted together by means of a hollow axle 44. A ball 48 is rotatably mounted on a rivet axle at the free end of the one arm. The ball 48 rolls or glides on the curved member 30 (depending on the respective load).

The other arm of the rocker 28 has catches 50 which are shaped to complement the hooks 40 so that they can be engaged by them. Sliding or displacing the carriage 36 on the adjusting spindle 32 thus causes the rocker 28 to pivot about the axle 42.

A release lever 52 which is pivotally mounted on the platesecured axle 22 is also located in the housing 24. The release lever 52 has sliding surfaces indicated by dotted lines in FIG. 2 which cooperate with pins 54 affixed to the carriage in a manner known per se, such that, when the release lever 52 is depressed, the carriage 36 is swung downwardly and the spring 26 is tensioned. The result is, as will be explained in the following, a pivoting movement of the heel assembly and release of the ski boot.

Figure 3:
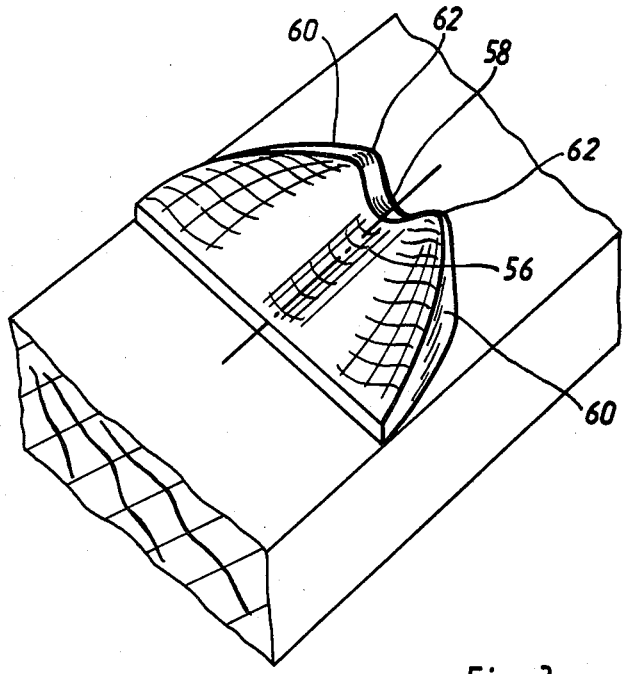
FIG. 3 is a perspective view of the curved member.

The curved member 30 is illustrated in perspective in FIG. 3. It has in the middle axis of the ski a first track 56 in the shape of a concavely vaulted groove which has a maximum dimension at 58. The track slopes toward the front, i.e. in the direction of the heel, to a lesser extent than toward the rear (see FIGS. 1 and 2 is this context).

The second track 60 extends along the top edge of the curved member 30 in the shape of an arc. The radius of this arc corresponds to the spacing between the ball 48 and the trunnion 12. Laterally of the middle axis indicated by the dot-dash line in FIG. 3, the track 60 has one prominence 62 on each side and then diminishes in its further course to the edge of the ski.

The sliding cam or ball 48 is located in the rear, downwardly falling area of the first track 56, behind or beneath the prominence 58 and between the prominences 62 of the second track 60 when the binding is in the downhill running position as illustrated in FIG. 2. The total height of the curved member 30 is chosen such that the rocker 28 forms an angle of approximately 45° relative to the longitudinal axis of the ski.

When the heel assembly 20 is pivoted into its uppermost position, the ball 48 no longer contacts the track 56 so that the sole plate 14 together with the heel assembly can be freely pivoted back and forth (FIG. 1 does not illustrate the position of complete release, but rather the moment shortly before the ball 48 disengages from the track 56).

The safety binding functions as follows. Starting from the downhill running position as shown in FIG. 2, the heel moves upwardly as the result of a front load, thereby pivoting the heel assembly 20 clockwise about the axle 22. Due to this displacement, the ball 48 is rolled along the track 56 to the left (FIGS. 1 and 2), i.e. the ball is urged to roll over the prominence 58. If the load eases before the prominence 58 has been surmounted, the ball is urged back into its neutral position (FIG. 2) again by the spring 26. Hence, the binding does not open, but remains flexible within certain limits which are dependent on the contour of the track 56. If the load does continue, however, the ball 48 will surmount the prominence 58 due to the tension of the spring 26 and will slide downwardly along that segment of the track 56 which descends towards the heel until the rocker 28 and the curved member 30 disengage completely. In so doing, the housing member 20 pivots upwardly, releasing the boot. The extension spring 26 is compressed briefly as the ball surmounts the prominence 58 and is relaxed thereafter.

When the skier replaces his boot in the binding, the heel assembly is pressed downwardly due to the contact with the boot. In so doing, the ball again gains contact with that segment of the track 56 which gradually ascends, the rocker 28 pivots and the spring 26 is tensioned accordingly. After the ball has again surmounted the prominence 58, the rocker 28 returns to its neutral downhill/running position shown in FIG. 2 in which the boot is appropriately secured to the sole plate.

In the event of torsional load, the sole plate pivots and the heel assembly 20 rotates to the left or right out of its middle position. While pivoting, the ball 48 must surmount one of the two prominences 62 on track 60. The torsional force, however, must continue through a specific angle of rotation so that this can happen. If the force decreases before this final angle is attained, the binding again snaps back into its middle position. The track 60 is designed as a rule such that this lateral flexibility is greater than that for pure tensile or frontal loads. In the event the sole plate pivots laterally, the positive engagement between the heel assembly 20 and the boot does not loosen until the prominence 62 has been surmounted. Both the large, arbitrarily adjustable flexibility ranges as well as the positive heel assembly/-heel engagement maintained in the flexibility ranges are of decisive importance for the comfort and safety behavior of the ski binding.

If the ball 48 surmounts one of the prominences 62 under torsional load, the ball runs forward along the descending segment of the track 60 until the rocker 28 is released completely, thereby pivoting the heel assembly 20 towards the rear and releasing the boot. A leaf spring can be attached in the trunnion 12 which rotates the outwardly pivoted sole plate 14 back into its middle position so that, to reattach the ski boot to the binding, the only thing that has to be done is to depress the heel assembly 20.

In the event of a combined torsional/frontal fall, the sole plate is rotated through a specific angle and, at the same time, the heel mount is pivoted upwardly owing to the tensile load. In so doing, the ball 48 surmounts a segment of the curved member located between the prominence 58 and one of the prominences 62. Accordingly, the release force ranges between that for a simple frontal fall and that for a simple torsional fall. The release kinematics, however, are independent of the type of fall, i.e. they are always the same even in the case of the cited combined falls, so that consequently the release values can be adjusted and set exactly.

What is claimed is:

1. A safety ski binding comprising:

a sole plate pivotally connected to a ski by a trunnion approximately below the heel position of a skier;

a heel assembly on said sole plate adapted to pivot about a first axis transverse to said ski, said assembly being connected to a holder member having means for engaging the heel of a user for maintaining that heel of the sole plate;

spring means urging said assembly to pivot about said axis in a direction to maintain a heel on the sole plate; said spring means including a carriage biased by spring force to a normal position;

a curved cam member rigidly attached to the ski;

a double-armed rocker pivotally mounted on said assembly about an axis extending laterally perpendicular to the ski, one arm of said rocker being rearwardly directed and being formed to define a cam follower engaging said curved cam member, the other arm of said rocker being pivotally connected to said carriage whereby said spring means biases said carriage to pivot said rocker and hold said cam follower against said curved cam member in a region thereof wheren said holder members holds the heel on the sole plate and said sole plate is held against free rotation on said ski.

2. A safety ski binding as defined in claim 1 wherein said holding member is in the form of a housing pivoted about said first axis to said sole plate;

said assembly including a spindle abuting said housing, said spring means urging said spindle against said housing to urge the same in a heel holding direction;

the pivot axis of said double-armed rocker being located below said first axis.

3. A safety ski binding as defined in claim 1 wherein said curved cam member defines a central track laterally bounded by prominences extending longitudinally of said ski, whereby pivotal movement of said sole plate about said trunnion causes said cam follower to rise over one of said prominences against the action of said spring means and pass off said curved cam member to thereby release said holder member from a user's heel.

4. A safety ski binding as defined in claim 3 wherein said prominences diminish in height in a longitudinal direction forwardly of said ski.

5. A safety ski binding as defined in claim 1 including a release lever pivoted to said sole plate and arranged to selectively compress said spring and thereby move said carriage to release said cam follower from said curved cam member.

6. A safety ski binding as defined in claim 2 wherein said spindle is inclined upwardly away from said heel position and is arranged to selectively adjust the force of said springmeans.

7. A safety ski binding as defined in claim 1 wherein said rocker consists of two parallel tabs riveted together by a hollow axle.

8. A safety ski binding as defined in claim 7 wherein said cam follower is a ball rotatably mounted on a rivet axle extending between said tabs.

* * * * *